US009130306B2

(12) United States Patent
Hotea et al.

(10) Patent No.: US 9,130,306 B2
(45) Date of Patent: Sep. 8, 2015

(54) CONNECTOR ASSEMBLY FOR AN ELECTRICAL PLUG-IN CONNECTOR, ELECTRICAL PLUG-IN CONNECTOR AND MANUFACTURED ELECTRIC CABLE

(75) Inventors: Gabriel Hotea, Offenbach (DE); Guenther Mumper, Egelsbach (DE); Hartmut Ripper, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/700,986

(22) PCT Filed: May 18, 2011

(86) PCT No.: PCT/EP2011/058067

§ 371 (c)(1),
(2), (4) Date: Nov. 29, 2012

(87) PCT Pub. No.: WO2011/151181

PCT Pub. Date: Dec. 8, 2011

(65) Prior Publication Data

US 2013/0072054 A1 Mar. 21, 2013

(30) Foreign Application Priority Data

Jun. 2, 2010 (DE) ..... 10 2010 029 670

(51) Int. Cl.
*H01R 13/58* (2006.01)
*H01R 13/506* (2006.01)
(Continued)

(52) U.S. Cl.
CPC ..... *H01R 13/58* (2013.01); *H01R 13/506* (2013.01); *H01R 13/582* (2013.01); *H01R 13/6273* (2013.01); *H01R 13/6633* (2013.01)

(58) Field of Classification Search
CPC . H01R 13/5808; H01R 103/00; H01R 13/516
USPC ..... 439/455, 453, 447, 568
See application file for complete search history.

(56) References Cited

U.S. PATENT DOCUMENTS 4,880,397 A * 11/1989 Dawson et al. ..... 439/620.09
6,139,372 A * 10/2000 Yang ..... 439/701
(Continued)

FOREIGN PATENT DOCUMENTS

DE 102007026582 B3 12/2008
DE 602005005603 T2 4/2009
(Continued)

OTHER PUBLICATIONS

International Search Report and Written Opinion issued by the European Patent Office, dated Jun. 28, 2011, for related International Application No. PCT/EP2011/058067; 11 pages.
(Continued)

*Primary Examiner* — Phuongchi T Nguyen
(74) *Attorney, Agent, or Firm* — Faegre Baker Daniels LLP

(57) ABSTRACT

The invention relates to a connector assembly for an electrical plug-in connector (10), in particular an electrical socket plug-in connector (10) for an igniter of an airbag, with a contact casing (100) in which at least one electrical contact means (50) can be provided, and a contact securing means (200) which has a locking means (210) by means of which the contact means (50) can be locked in the contact casing (100); the contact securing means (200) having a strain-relief means (230) by means of which at least partially a strain relief for an electric line (60) connected to the contact means (50) can be set up on/in the connector assembly (12); and/or the connector assembly (12) having a plug-in-connector securing means (400) which, starting from a pre-latching position (V) on the connector assembly (12), for a final latching position (E) can be brought into engagement with the contact securing means (200) and/or a strain-relief cover (300) of the connector assembly (12).

13 Claims, 8 Drawing Sheets

(51) Int. Cl.
*H01R 13/627* (2006.01)
*H01R 13/66* (2006.01)

(56) References Cited

U.S. PATENT DOCUMENTS

| | | | | |
|---|---|---|---|---|
| 7,120,024 | B2 * | 10/2006 | Watanabe et al. | 361/704 |
| 7,163,408 | B1 * | 1/2007 | Chen et al. | 439/76.1 |
| 7,234,962 | B1 * | 6/2007 | Lin | 439/441 |
| 7,238,039 | B2 | 7/2007 | Holweg | |

FOREIGN PATENT DOCUMENTS

| | | | |
|---|---|---|---|
| EP | 2026421 | A1 | 2/2009 |
| WO | WO 2004/027938 | A1 | 4/2004 |
| WO | WO 2007/131535 | A1 | 11/2007 |

OTHER PUBLICATIONS

German Exam Report issued by the German Patent and Trademark Office, dated Apr. 15, 2011, for German priority Application No. 10 2010 029 670.8; 3 pages.

* cited by examiner

CONNECTOR ASSEMBLY FOR AN ELECTRICAL PLUG-IN CONNECTOR, ELECTRICAL PLUG-IN CONNECTOR AND MANUFACTURED ELECTRIC CABLE

The invention relates to a connector assembly for an electrical plug-in connector, in particular an electrical socket plug-in connector for an igniter of an airbag. Further, the invention relates to an electrical plug-in connector, in particular an electrical socket plug-in connector, or a manufactured electric cable, for an igniter of an airbag, with a connector assembly according to the invention.

In the field of electronics and/or electrical engineering, a large number of electrical pin connectors and/or socket connectors—referred to below as (electrical) plug-in connectors—are known which serve to transmit electric power and/or electrical signals with a maximum possible range of voltages, currents, frequencies and data rates. Further, such plug-in connectors, in particular in the automotive sector, have to permanently ensure fault-less transmission of electrical signals and electric power in thermally stressed, damp, dirty and/or chemically aggressive environments. Owing to the great range of applications for plug-in connectors, a large number of specially optimised plug-in connectors are known.

Particularly in the case of safety-critical electrical connections, such as for example an electrically conductive connection between an igniter, e.g. of an airbag, or a belt tensioning means and an electrical control unit of a passenger restraint system in a motor vehicle, high demands are made on the electrical plug-in connection which is to be produced. A plug-in connector which can be used for this must operate error-free and be of compact design. In this case, e.g. an airbag plug-in connector must on one hand absolutely reliably transmit a triggering signal to the igniter of the airbag, and on the other hand electrical spurious signals, which result e.g. from voltage peaks in the vehicle electronic system, must not trigger unintentional activation of the airbag. In order to prevent such electrical voltage peaks or to minimise the effects thereof, plug-in connections for airbags or airbag plug-in connectors have electrical or electromagnetic choke means High demands are made on the electrical connections within the airbag plug-in connector which are to be produced and the electrically conductive plug-in connections which are to be produced with the airbag plug-in connector. In particular, in this case secure assembling of the electrical contact means to be arranged within the airbag plug-in connector should be ensured, it being desired to attain as simple as possible assembly not only for reasons of cost, but also due to a lower error rate upon assembly which can be achieved thereby. In the assembly of the contact means in the airbag plug-in connector, usually also assembly of a choke means, such as a ferrite core choke—referred to as "ferrite" for short—takes place.

In the case of electrical plug-in connectors, it may be a requirement for loads on the electric lines provided thereon, such as line movements and/or line vibrations, which occur e.g. due to harsh environmental conditions in a motor vehicle, not to be transferred to the electrical connection between the line in question and the associated electrical contact means, and furthermore also not to the electrical connection between two contact means of an electrical plug-in connection. Such mechanical loads on the plug-in connector or the plug-in connection consisting of plug-in connector and a mating connector may be kept away by a separate interception means, arranged behind the plug-in connector or in front of and behind the plug-in connection, of the lines connected to the contact elements, but this yields a disadvantageous, increased expense in terms of parts, costs and assembly. Further line fixings directly on an electrical plug-in connector are known.

Thus DE 10 2006 028 202 A1 discloses an electrical plug-in connector for motor vehicles, with a contact casing and a cover pivotably connected to the contact casing, which cover is arranged on the contact casing between an insertion side and a cable feed side thereof such that a cover section forms a section of the contact casing when the cover is closed. In a section of the cover there is at least one guide slot which opens outwards to a free end of the lid, in which slot at least one associated electric line can be positioned upon closing of the cover, the guide slot of the cover, when the cover is closed, being constricted such that the line is fixed therein.

It is an object of the invention to devise an improved connector assembly for a plug-in connector and an improved electrical plug-in connector. In this case, secure and simple assembly of an electrical contact means and a choke means, in particular a ferrite, within the connector assembly should be able to be carried out as inexpensively as possible. In such case, permanently reliable strain relief of the electric lines provided on the plug-in connector should be realised, and the choke means should be accommodated in the plug-in connector in a manner as free from play as possible in at least one spatial dimension. The assembly of the contact means and also of the choke means should further be possible at a customer's premises, such that the latter can independently equip the plug-in connector with a line which is already at least partially made up. Furthermore, the connector assembly and hence also the plug-in connector should be designed to be small, compact and robust.

The object of the invention is achieved by means of a connector assembly for an electrical plug-in connector, in particular an electrical socket plug-in connector for an igniter of an airbag, according to claim 1; and an electrical plug-in connector, in particular an electrical socket plug-in connector, or a manufactured electric cable, in particular for an igniter of an airbag, according to claim 10. Advantageous developments of the invention will become apparent from the dependent claims.

The connector assembly according to the invention or the electrical plug-in connector according to the invention has a contact casing in which at least one electrical contact means can be provided or is provided. Further, a contact securing means is provided with which the contact means can be locked or is locked in the contact casing. The following embodiments relate only to the plug-in connector, but can be transferred analogously to the connector assembly. The invention in this case comprises a plurality of variants, with each variant having a main feature and the variants being able to be realised individually or in any combination whatsoever on a plug-in connector or a connector assembly. In the description of the figures further below, only two embodiments are discussed, with generally embodiment of the invention [sic] realising one or a plurality of variants on an individual connector assembly or an individual plug-in connector.

Thus in one variant of the invention the contact securing means for the electrical contact means is designed such that at least partially a strain relief for an electric line on/in the plug-in connector is set up by means of a strain-relief means provided thereon. Preferably in this case the strain-relief means is formed in one piece in terms of material with the contact securing means. In this case, in an extended variant, the plug-in connector may additionally have a strain-relief cover with a strain-relief means which is preferably formed in one piece in terms of material thereon, by means of which, in cooperation with the strain-relief means of the contact securing means, a strain relief for the line which is electrically connected to the plug-in connector is set up. In embodiments thereof, upon the setting-up of the strain relief for the line, the two strain-relief means can be moved substantially towards each other, with, by means of the strain-relief means, an electrical insulation of the line being able to be clamped preferably in each case by means of at least one tooth of the strain-relief means in question.

In one embodiment of the invention, the contact securing means and the strain-relief cover can be secured on each other in the region of the respective strain-relief means. In this case, a latch means formed e.g. as a latch hook can be provided on the strain-relief means of the contact securing means, and a latch means formed e.g. as a latch shoulder can be provided on the strain-relief means of the strain-relief cover. In this case it is preferred for the one latch means preferably to be provided externally on a free longitudinal end section of the strain-relief means of the contact securing means, and for the other latch means preferably to be provided internally on a middle section of the strain-relief means of the strain-relief cover.

Further, the strain-relief means of the contact securing means may engage in a recess in the strain-relief means of the strain-relief cover. In an engaged state of the two strain-relief means, the insulation of the electric line is then pressed against two sections of the strain-relief means of the strain-relief cover by means of a section of the strain-relief means of the contact securing means. A clamping force for this preferably results from the latching of the contact securing means with the strain-relief cover and a respective counter-surface of the contact securing means or of the strain-relief cover on/in the plug-in connector. This is for example a supporting of the contact securing means on a choke means (see below) and latching of the contact securing means with a contact casing of the plug-in connector away from the strain-relief means thereof, and/or a supporting of the strain-relief cover on a guide tab of the contact casing.

In another variant of the invention, the plug-in connector additionally or alternatively has a plug-in-connector securing means which, starting from a pre-latching position on the connector assembly, for a final latching position can be brought into engagement with the contact securing means and/or a/the strain-relief cover of the plug-in connector. In this case, the plug-in-connector securing means may have an engagement means formed in particular as a projection or a stud, which engagement means can be brought into engagement with an engagement means of the contact securing means which is in particular formed as a recess or a through-recess. Further, the plug-in-connector securing means may have a latch means in particular formed as a latch projection or a latch hook, which latch means can be brought into engagement with a latch means of the strain-relief cover which is in particular formed as an undercut recess or a through-recess. This means that the contact securing means and/or the strain-relief cover can no longer move away from the plug-in connector for example due to vibrations.

In a further variant of the invention, a choke means for the plug-in connector which is formed in particular as a ferrite is received approximately without play in one dimension between the contact securing means and a/the strain-relief cover. For this, the strain-relief cover may have a stop or a projection and/or the contact securing means may have a projection or a stop, with the choke means being able to be clamped therebetween. Further, the strain-relief cover and/or the contact securing means may alternatively or in addition have a spring means, such as a spring tab, by means of which the choke means can be pressed in the direction of the strain-relief cover or in the direction of the contact securing means.

In embodiments of the invention, the contact securing means may have a longitudinal section extending along a longitudinal direction of the plug-in connector, which section connects the locking means to the strain-relief means in particular integrally with each other. The projection or stop or the spring means or spring tab for clamping the choke means may be provided internally on the longitudinal section and preferably adjacent to the strain-relief means thereof. The contact securing means in embodiments of the plug-in connector in a projection has approximately a U-shape, the two limbs of this "U" preferably being designed such that the contact securing means is thereby secured on/in the plug-in connector. Further, by means of the plug-in-connector securing means the contact securing means can be able to be held on the plug-in connector on a longitudinal end and/or a middle section of its longitudinal section, or the contact securing means can be secured therewith on the contact casing.

In embodiments of the invention, the plug-in-connector securing means may be a component integrated in the plug-in connector which has in particular in sections a completely circumambient wall. The wall may in this case have a guide recess with which the plug-in-connector securing means is seated in movable manner e.g. on a guide tab of the contact casing of the plug-in connector. Further, the strain-relief means of the contact securing means can engage in a section of the guide tab which projects out of the guide recess of the plug-in-connector securing means, and the choke means can be received between the strain-relief means of the strain-relief cover and a step section of the contact means. Furthermore, the contact securing means can be latched to the contact casing on an end of its longitudinal section which is located opposite its strain-relief means.

According to one variant of the invention, a connector assembly for a plug-in connector or an electrical plug-in connector is devised which realises reliable strain relief of the electric lines provided on the plug-in connector; guarantees secure, simple and inexpensive assembly of an electrical contact means and a choke means in the connector assembly or in the plug-in connector; and is of small, compact and robust design. In this case, the assembly of the plug-in connector is possible at a customer's premises such that the latter can independently equip the connector assembly with a line which is already at least partially made up.

In particular due to the use of a plurality of mutual latchings of contact securing means, strain-relief cover and plug-in-connector securing means, a robust plug-in connector is yielded, the contact casing of which absorbs all the forces and introduces them via a mating-connector casing of an electrical mating connector, such as a casing connection, into a casing. In such case, the electrical contact means arranged in the connector assembly, electrical connections with the mating connector which can be produced therewith, an electrical connection of the contact means to electric lines and a choke means which is seated on the lines or a choke means which is electrically connected to the lines remain largely free from forces, which ensures permanent functioning of the plug-in connector.

The invention will be explained in greater detail below using examples of embodiment with reference to the appended drawings. In the detailed drawings.

Figure 7:
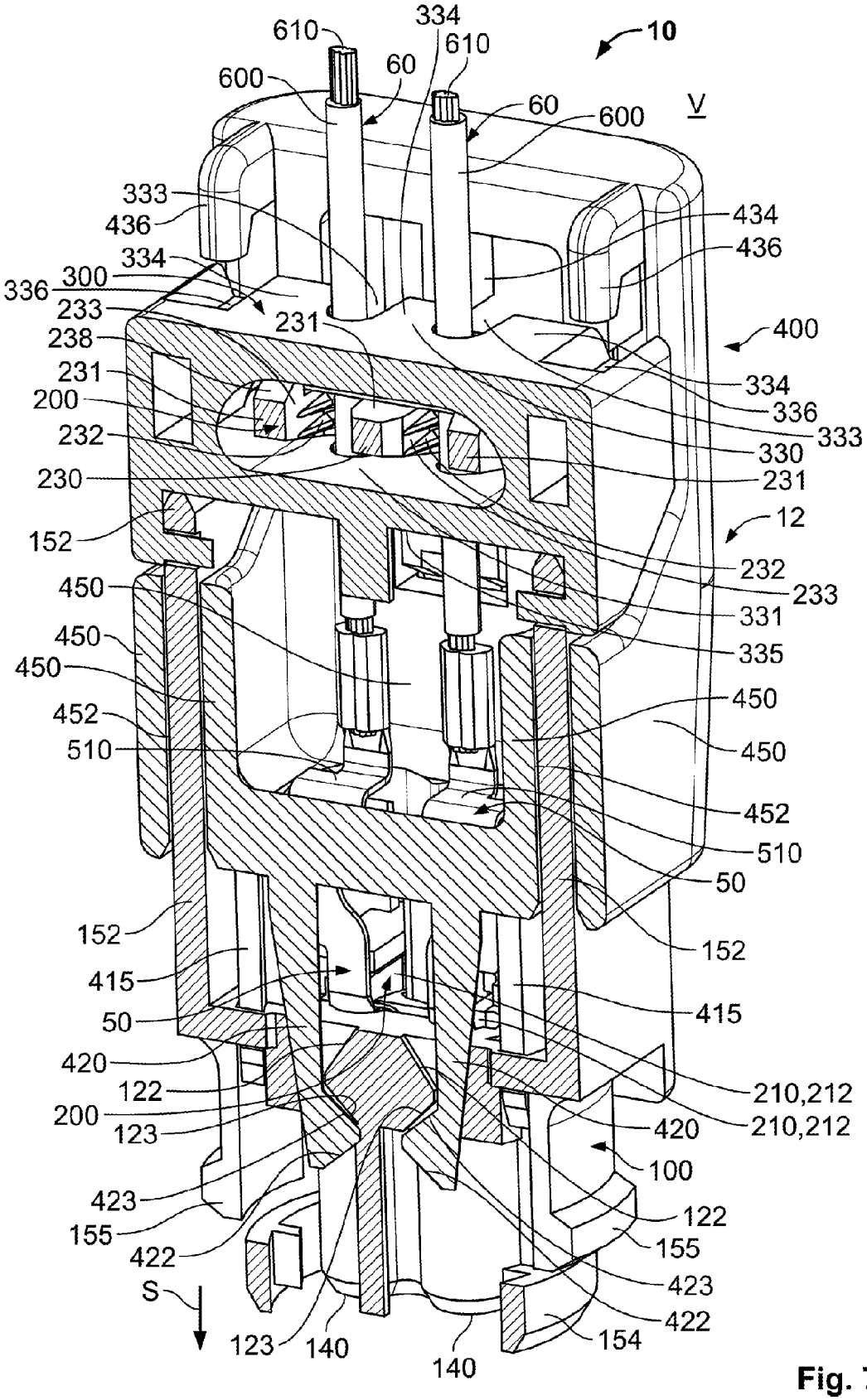
Figure 8:
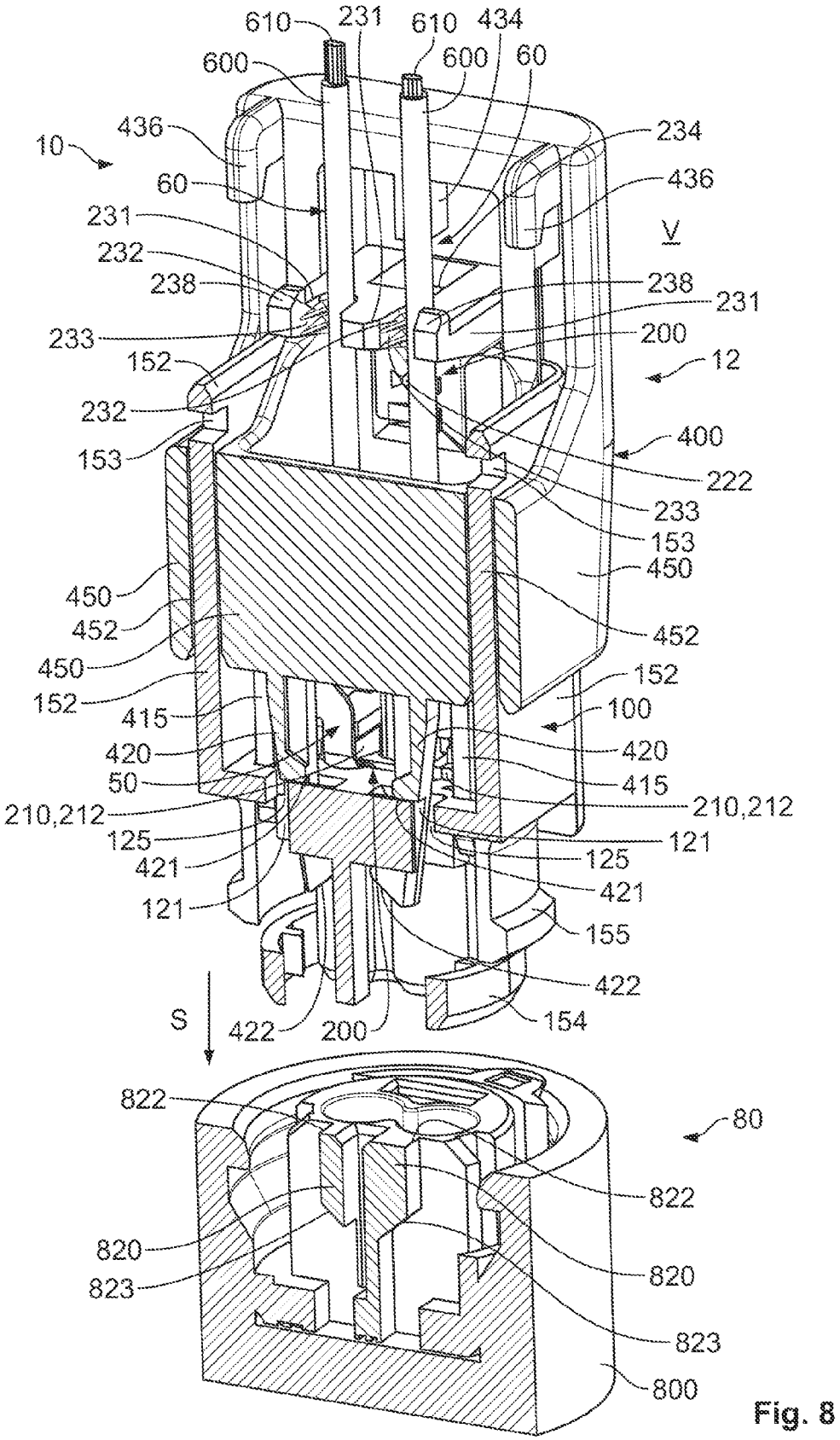

FIG. 7 depicts a lateral and transversely sectioned perspective view of the second embodiment of the plug-in connector without ferrite, the plug-in connector being shown in the region of a latching of a plug-in-connector securing means counter to the direction of actuation thereof; and FIG. 8 depicts a perspective view analogous to FIG. 7, additionally without a strain-relief cover, the plug-in connector being shown in the region of a latching of the plug-in-connector securing means in the direction of actuation thereof.

The invention will be explained in greater detail below with reference to an electrical 180° socket plug-in connector for an electrical plug-in connection for an airbag in the automotive sector. The invention is however not restricted to such forms of application, but can also be used in other fields of electrical engineering, in particular in safety-critical applications Of course, the invention can also be applied to electrical male or pin plug-in connectors. Two special embodiments of the invention are illustrated in greater detail below, each of which comprise a plurality of the above variants of the invention. It is of course possible to realise variants explained above individually or in a plurality in one embodiment of the invention.

If further mention is made below of blocking, latching, locking or engaging, these terms may be used synonymously. That is to say that measures relating to blocking or latching may also be applied to locking or engaging, and vice versa. That is to say that the measures portrayed in detail are interchangeable with each other. Thus e.g. a hook which mechanically cooperates with a projection can be substituted by other measures, such as by a hook or a projection in cooperation with an optionally undercut recess or a through-recess; further, two cooperating hooks, two cooperating shoulders, a hook which cooperates with a shoulder and vice versa or mixed forms thereof can be used.

Figure 1:
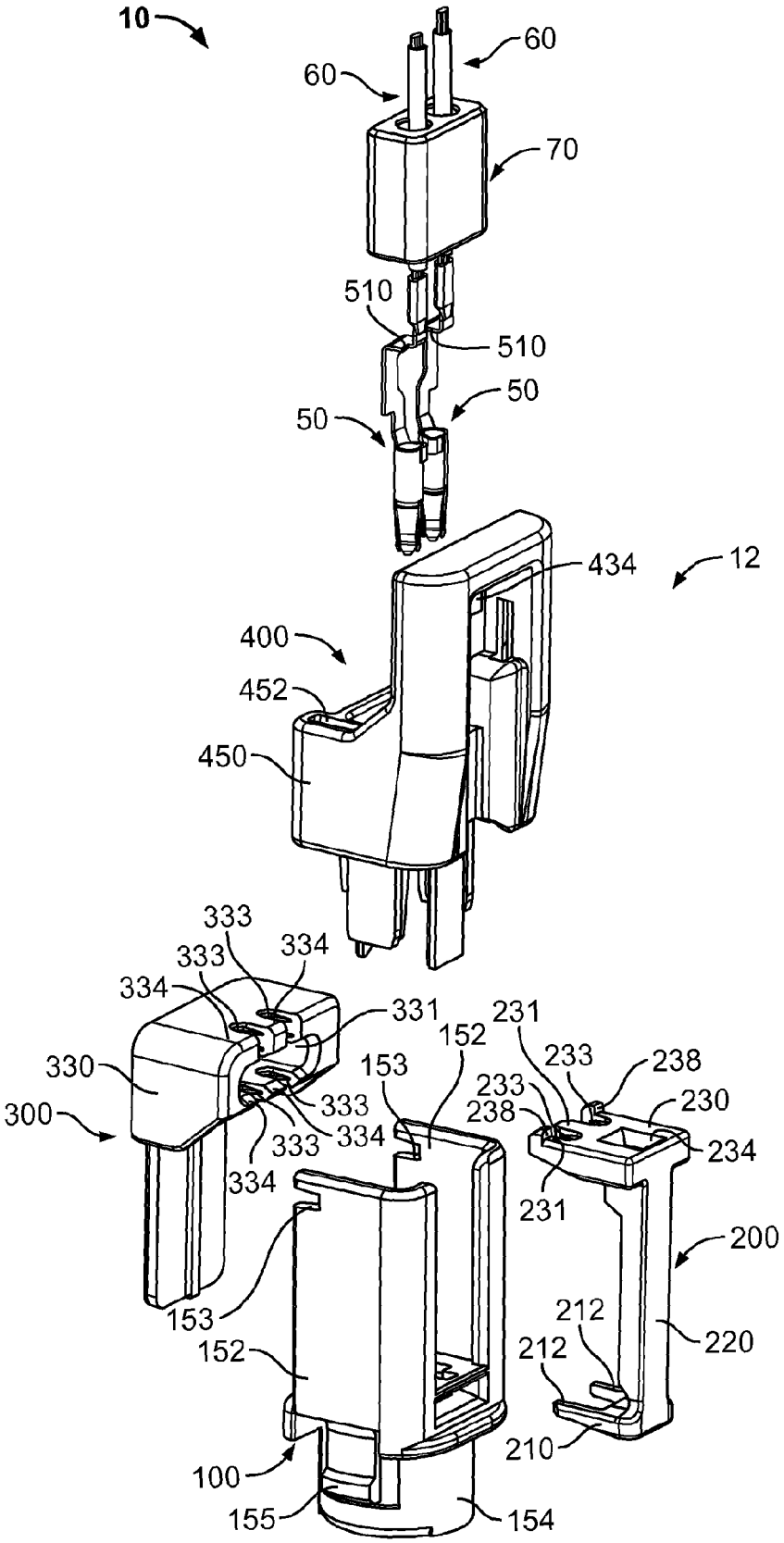
FIG. 1 depicts, in a three-dimensional exploded view, a first embodiment of the connector assembly according to the invention and of the electrical plug-in connector according to the invention.

The exploded view of FIG. 1 depicts the first embodiment of the connector assembly 12 according to the invention and of the electrical plug-in connector 10 according to the invention. The plug-in connector 10 differs from the connector assembly 12 in that it additionally has at least one electrical contact means 50, optionally at least one electric line 60 or one electric cable 60 and optionally a choke means 70. The electrical contact means 50 in the present case is formed as a preferably stamped socket contact 50 which is bent into shape, but may also be a male or pin contact, which does not necessarily have to be formed as a stamped part. The choke means 70 is formed here as a ferrite 70; another choke means 70, such as a diode, another electromagnetic or electrical choke, can of course be used instead of the ferrite 70.

Figure 2:
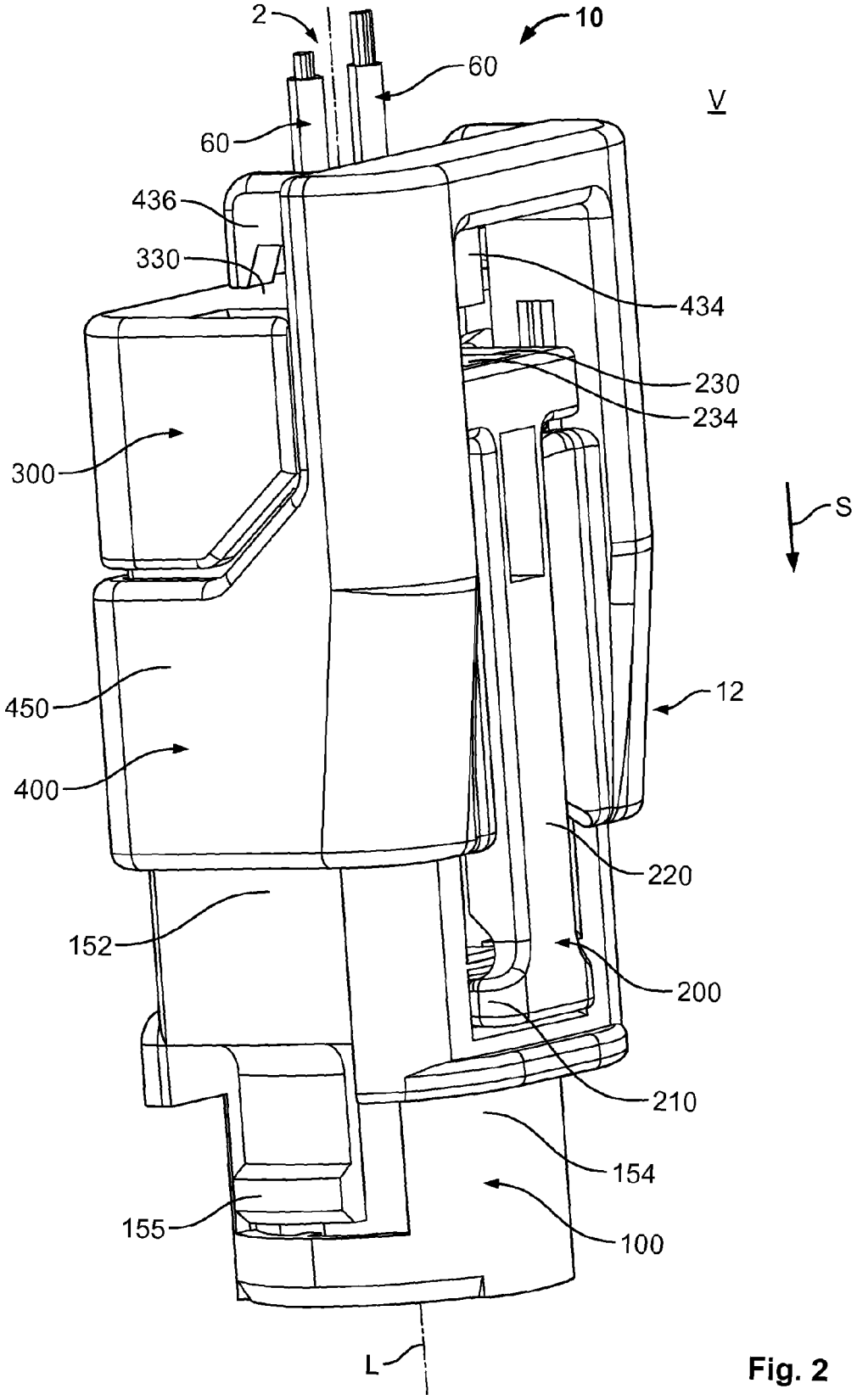
FIG. 2 depicts, in a lateral/rear perspective view, a second embodiment of an electrical plug-in connector according to the invention with a second embodiment of a connector assembly according to the invention.
Figure 3:
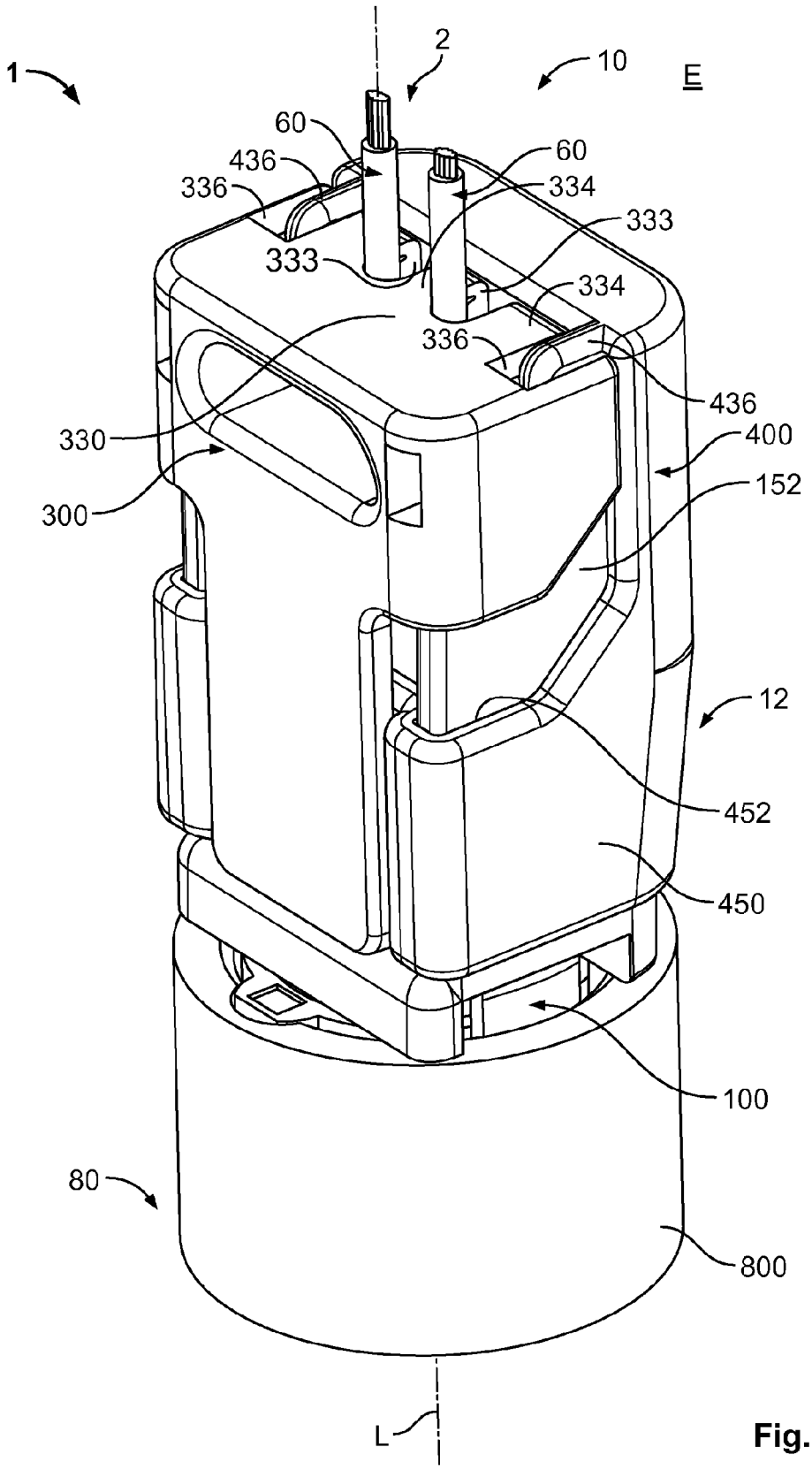
FIG. 3 depicts, in a lateral/front perspective view, the plug-in connector of FIG. 2 in a final latching position on an electrical mating connector.

The two embodiments of the connector assembly 12 and of the plug-in connector 10—see also FIGS. 2 and 3, both of which show the second embodiment of the invention—have in each case a contact casing 100, a contact securing means 200, a strain-relief cover 300 or strain-relief cap 300 and a plug-in-connector securing means 400 (CPA=Connector Position Assurance), each of these components 100, 200, 300, 400 preferably being produced in one piece in terms of material, e.g. in an injection-moulding process. That is to say that the functions, explained below, of each of these four components 100, 200, 300, 400 can preferably be realised with a one-piece component. In the case of the plug-in connector 10, all the above-named components 100, 200, 300, 400 are fastened directly or indirectly on/in the contact casing 100 thereof, with preferably two electrical contact means 50 being held within the contact casing 100 by means of the contact securing means 200, which securing means, preferably together with the strain-relief cover 300, provides a strain relief for preferably two electric lines 60 of the plug-in connector 10.

The plug-in-connector securing means 400 serves primarily for securing the plug-in connector 10 in an electrical mating connector 80 (see FIG. 3, which shows an electrical plug-in connection 1 according to the invention), which may be formed e.g. as a casing connection 80, a mating connector 80, a header 80 or an interface 80. For this, the plug-in-connector securing means 400 is located in a final latching position E on the plug-in connector 10 or on the contact casing 100 thereof (see FIG. 3), in which position it blocks the plug-in connector 10 or the contact casing 100 thereof in a mating-connector casing 800 of the mating connector 80. Before the assembling of the plug-in connector 10 with the mating connector 80, the plug-in-connector securing means 400 is in a pre-latching position V (see FIG. 2) on the plug-in connector 10 or on the contact casing 100 thereof. Upon moving the plug-in-connector securing means 400 out of its pre-latching position V into its final latching position E, the plug-in-connector securing means 400 additionally latches with the contact securing means 200 (first embodiment) and/or with the strain-relief cover 300 (second embodiment).

The contact casing 100 has, for setting up an electrical connection with the mating connector 80, a casing body 154 on which at least one, but preferably two, latch tabs 155 are provided which latch in the mating-connector casing 800. Following on from this, first the final latching position E of the plug-in-connector securing means 400 can be set up in the plug-in connection 1. See FIGS. 4 to 8 on this point and also below. In this case, the contact casing 100 produces an electrically conductive connection between the electrical contact means 50 which are received in the casing body 154 in receptacles 140 provided therein and electrical contact means 90, formed in particular as pin contacts 90, of the mating connector 80.

Further, the contact casing 100 has at least one, but preferably two, guide tabs 152 which project away from the casing body 154 counter to a direction of insertion S of the plug-in connector 10, on which tabs the plug-in-connector securing means 400 can be received in movable manner. For this, the plug-in-connector securing means 400 has in each case a guide recess 452 in a wall 450 which preferably in sections is completely circumambient. Preferably a respective guide tab 152, in a corner region of the contact casing 100, is guided around this corner in a curve, so that the respective guide tab 152 is formed approximately in an L-shape in a cross-section. The respective guide recess 452 is formed corresponding to this. This means that the plug-in-connector securing means 400 can only move in two directions on the plug-in connector 10, namely upwards or downwards along the guide tabs 152.

On a free longitudinal end section, the guide tabs 152 have in each case a recess 153 in which a section of the strain-relief cover 300 which corresponds thereto can engage, so that the latter is held in one or two lateral directions on the plug-in connector 10, for which the strain-relief cover 300 in the assembled state on the plug-in connector 10 has a wall or a projection adjacent to the respective recess 153. The respective recess 153 in this case extends in the direction of a two-dimensional extent of the guide tab 154 into the respective guide tab 154, i.e. into the cross-sectional longitudinal direction thereof, with the respective recess 153 being provided on that side of the guide tab 154 in question on which the strain-relief cover 300 is also plugged onto the plug-in connector 10.

The contact securing means 200 has approximately the shape of a "U" in a cross-section, one limb being formed as a locking means 210 for the electrical contact means 50, and another limb as a strain-relief means 230. The strain-relief means 230 realises, on its own (not shown in the drawings) or in cooperation with a strain-relief means 330 of the strain-relief cover 300, strain relief for the electric lines 60, the contact securing means 200 securing the strain-relief cover 300 on the plug-in connector 10. If only the strain-relief means 230 of the contact securing means 200 is provided as strain relief, this may be constructed as explained below and may further press the lines 60 against a stop which is provided e.g. on the contact casing 100.

Figure 6:
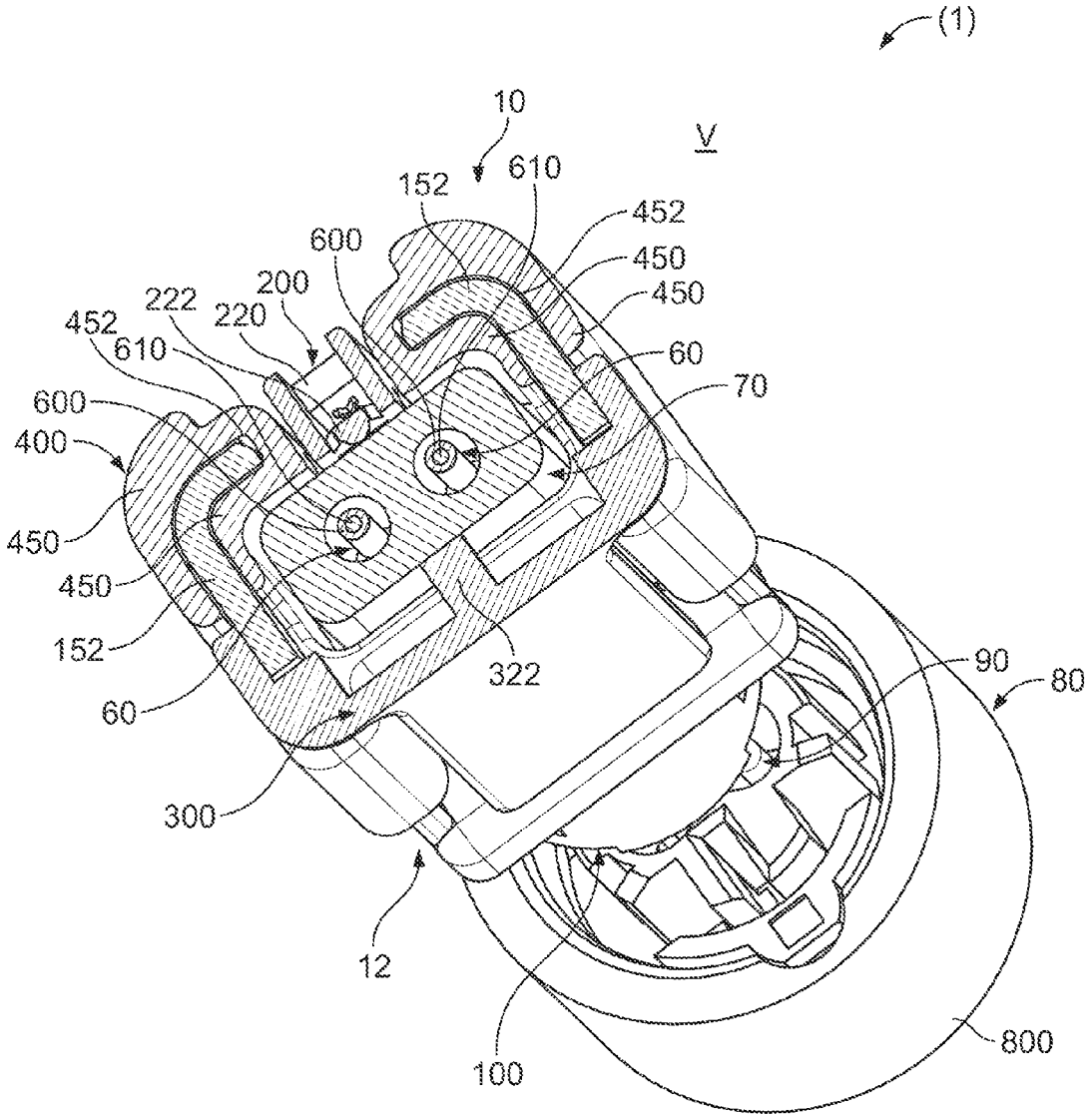
FIG. 6 depicts the plug-in connector in a perspective view from above, which can be applied to both embodiments, the plug-in connector being shown in section in the region of a clamping of a ferrite.

The two limbs of the contact securing means 200 are connected together via a longitudinal section 220 (crosspiece of the "U"), on which a projection 222 which is directed inwards in the assembled state of the contact securing means 200 on the plug-in connector 10 is provided integrally, by means of which the ferrite 70 can be pressed against the strain-relief cover 300, preferably against a stop 322 or projection 322 provided on the strain-relief cover 300 (see FIG. 6). Instead of a projection 222, for example also an optionally resilient tab may be used; this can also be applied to the inner stop 322 or projection 322 of the strain-relief cover 300. This secures the ferrite 70 in at least two directions, and depending on a strength of this clamping the ferrite 70 is also secured in the other two dimensions.

The locking means 210 of the contact securing means 200 has, according to a number of the electrical contact means 50, preferably just the same number of locking projections 212. That is to say that each contact means 50 has its individual locking projection 212 with which it is held in the respective receptacle 140 of the contact casing 100. It is however also possible to provide an individual locking projection for two contact means 50 in each case, or two locking projections 212 for three contact means 50 in each case. Further, the contact securing means 200 is latched on the contact casing 100 in the region of the locking means 210, for which the locking means 210 preferably has a latch means 214 formed as a latch projection 214, and the contact casing 100 has a latch means 114 preferably formed as a latch shoulder 114 (see FIG. 4).

The strain-relief means 230 of the contact securing means 200 is preferably constructed in comb-like manner, with corresponding recesses 233 being provided between two prongs 231 of this comb-like structure according to a number of electric lines 60 on the plug-in connector 10. That is to say that preferably one prong 231 more is provided on the strain-relief means 230 than corresponds to a number of electric lines 60 on the plug-in connector 10. A short longitudinal section of a line 60 can be received and clamped between two prongs 231, i.e. in a recess 233. For this, the respective line 60 is pressed into the recess 233 in question, which is done e.g. by means of corresponding sections of the strain-relief cover 300. This may however also be done by latching of the strain-relief means 230 and a corresponding stop (not shown in the drawings).

A recess 233 between two prongs 231 tapers inwards, with at least one tooth 232 or one strain-relief tooth 232 being provided internally on the recess 233, by means of which tooth an electrical insulation 600 of the line 60 can be deformed or clamped. The tooth 232 in question in this case extends preferably lengthwise along the recess 233 in question, and therefore merges from one prong 231 to the next. The toothed edges of the recess 233, in the case of a set-up strain relief, press the lines 60 against corresponding toothed edges of the strain-relief cover 300 (see FIGS. 4, 5 and 7).

In the case of an assembled plug-in connector 10, the contact securing means 200 is preferably latched with the strain-relief cover 300 in the region of its strain-relief means 230. For this, the strain-relief means 230 preferably has a latch means 238 formed as a latch hook 238, which means latches with a latch means 338, preferably formed as a latch shoulder 338, of the strain-relief cover 300 (see FIG. 4). In this case, preferably two latch hooks 238 are provided on a respective longitudinal end section of the two outer prongs 231 of the strain-relief means 230, which hooks are latched internally on the latch shoulder 338 of the strain-relief cover 300. The latch shoulder 338 is preferably provided as a projection behind an opening of a recess 331 of the strain-relief cover 300 into which the strain-relief means 230 of the contact securing means 200 can engage for the purpose of strain relief for the lines 60.

Further, contact securing means 200 has in the region of its strain-relief means 230, preferably accessible from the end face, an engagement means 234 formed in particular as an engagement recess 234. Into this, in the final latching position E of the plug-in-connector securing means 400, an engagement means 434, preferably formed as a projection 434 or stud 434, of the plug-in-connector securing means 400 can engage, which secures or holds the contact securing means 200 additionally on the plug-in connector 10.

The strain-relief means 330 of the strain-relief cover 300 or of the strain-relief cap 300 is preferably formed approximately as a cuboid which is open on one or two sides and is partially hollow on the inside. That is to say that the cuboid has a recess 331 accessible from one side of the cuboid in which the strain-relief means 230 of the contact securing means 200 can at least partially engage. In this case, in a longitudinal direction L of the plug-in connector 10 two strain-relief regions located one above the other are produced on the strain-relief cover 300, which regions are formed analogously to the strain-relief means 230 of the contact securing means 200 and will be explained only cursorily here. That is to say that the statements about the strain-relief means 230 of the contact securing means 200 can be transferred to such a strain-relief region of the strain-relief means 330 of the strain-relief cover 300.

Figure 4:
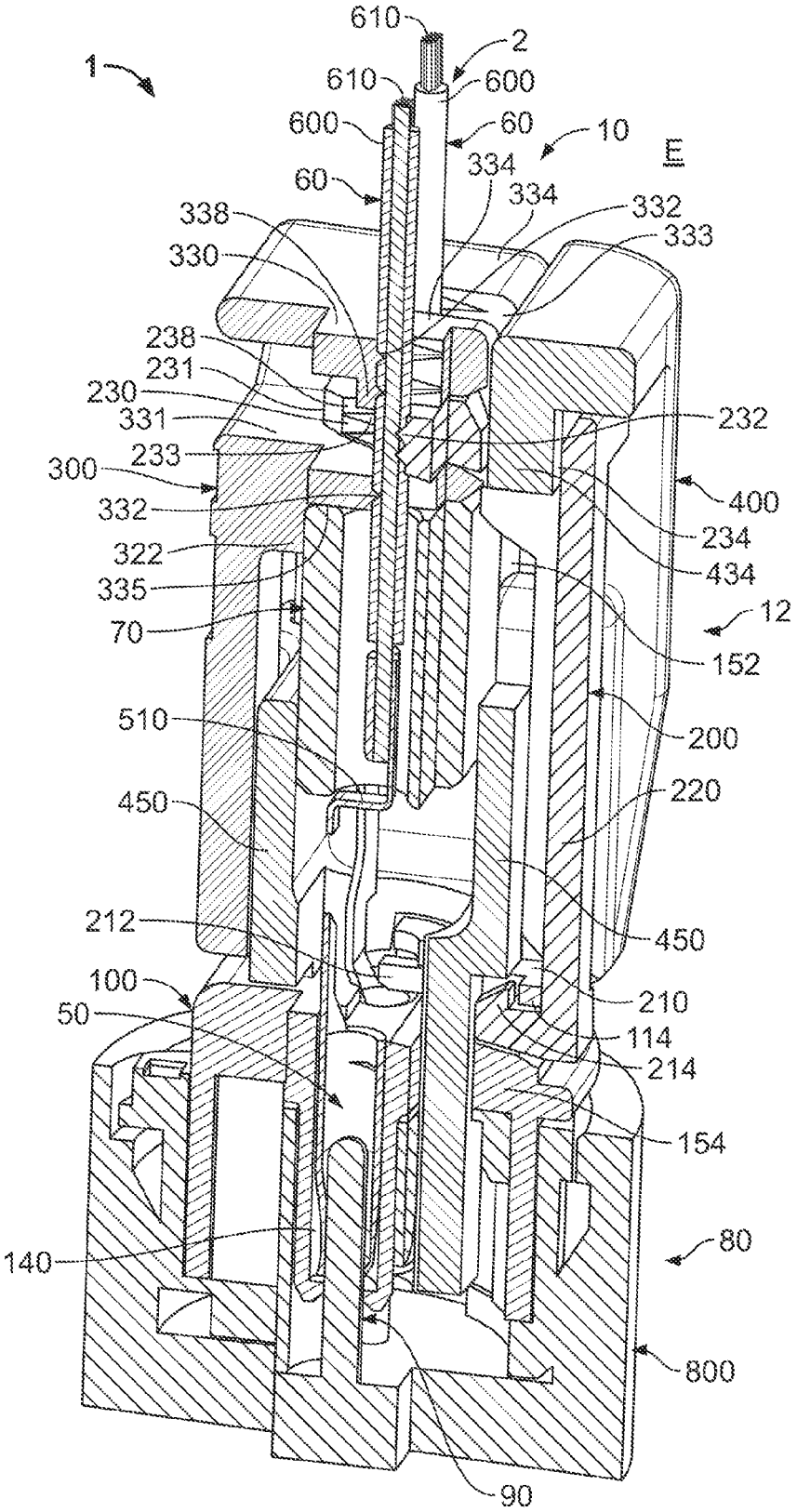
FIG. 4 depicts a lateral perspective view, sectioned lengthways, of the first embodiment of the plug-in connector in the final latching position on the mating connector.
Figure 5:
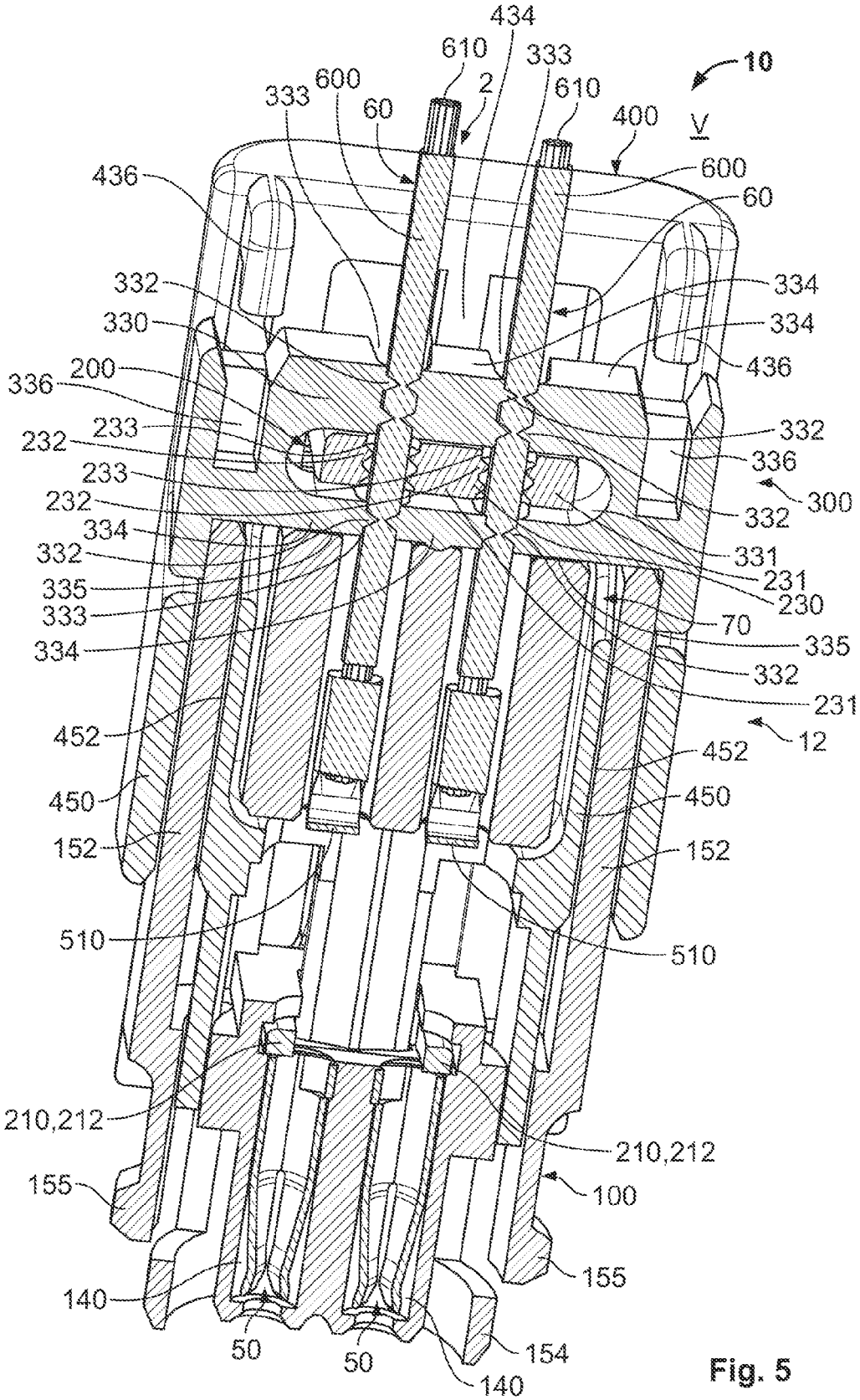
FIG. 5 depicts a lateral and transversely sectioned perspective view of the second embodiment of the plug-in connector in a pre-latching position in a region along electric lines and contact means.

Similarly to the strain-relief means 230 of the contact securing means 200, the two strain-relief regions are constructed in comb-like manner, with an electric line 60 being able to be received between two prongs 334 in a recess 333. In this case, again teeth 332 or strain-relief teeth 332 are provided which clamp the line 60. In the case of an assembled electrical plug-in connector 10 or a manufactured electric cable 2, the two strain-relief means 230, 330 of the connector assembly 12 are moved towards each other, the strain-relief means 230 of the contact securing means 200 engaging in the recess 331 of the strain-relief means 330 of the strain-relief cover 300 and both strain-relief means 230, 330 being latched to one another (FIG. 4). In this case, the strain-relief cover 300 is supported on the guide tabs 152, in particular an inner wall of the recess 153 of the guide tab 152 in question.

The electric line 60 in question in this case is clamped in sandwich-like manner, with two strain-relief sections of the strain-relief cover 300 in the longitudinal direction L of the plug-in connector 10 externally, and internally a strain relief section of the contact securing means 200, clamping the line 60 from two sides located opposite each other and thus realising a strain relief. That is to say that the strain relief of a single line 60 takes place by means of three recesses 333, 233, 333 or by means of six prongs 334, 334; 231, 231; 334, 334. Preferably in this case one or two strain-relief teeth 332 are located on a lower and an upper recess 333 (e.g. with reference to FIG. 4) of the strain-relief means 330 of the strain-relief cover 300, and two strain-relief teeth 332 are located on a recess 233 of the strain-relief means 230 of the contact securing means 200.

In the second embodiment of the invention, the strain-relief cover 300 has a latch means 336 preferably formed as an undercut recess 336 or a through-recess 336. The latch means 336 in this case is accessible to the plug-in-connector securing means 400 from the outside, with, in the final latching position E of the plug-in-connector securing means 400 on the plug-in connection 1, a latch means 436, preferably formed as a latch projection 436 or a latch hook 436, of the plug-in-connector securing means 400 latching with the latch means 336 of the strain-relief cover 300 (see FIGS. 2, 3, 5 and 7). At the same time as the plug-in-connector securing means 400 latches with the strain-relief cover 300, the plug-in-connector securing means 400 also latches with the contact securing means 200, so that these three components are fixed to one another.

Further, it is preferable for the strain-relief cover 300 not only in cooperation with the contact securing means 200 to hold the ferrite 70 in one dimension, but for the contact securing means 200 also to secure the ferrite 70 in cooperation with one or a plurality of the electrical contact means 50 also in a further dimension within the plug-in connector 10. For this, the strain-relief cover 300 has underneath and externally on its strain-relief means 330 a stop 335 or a shoulder 335, on which the ferrite 70 is seated in the assembled state in the plug-in connector 10. A counter-surface for the ferrite 70 is formed by one or a plurality of the contact means 50, which have preferably a step section 510 therefor (see FIGS. 4, 5, 7.) This can also be realised as a tab or projection on the appropriate contact means 50.

The interaction of the plug-in-connector securing means 400 with the contact securing means 200 and the strain-relief cover 300 has already been explained above, and therefore will not be dealt with further at this point. Here the pre-latching position V and the final latching position E of the plug-in-connector securing means 400 on the electrical plug-in connector 10 will be gone into in greater detail with reference to FIGS. 7 and 8. The plug-in-connector securing means 400 may in that case only be brought into its final latching position E once the plug-in connector 10 is latched with its latch tabs 155 in the electrical mating connector 80. If the plug-in-connector securing means 400 is in its final latching position E, then tabs 415 of the plug-in-connector securing means 400 block the latch tabs 155 of the contact casing 100 in the mating connector 80. The plug-in connector 10 can only be withdrawn from the mating connector 80 again once the plug-in-connector securing means 400 is again brought into its the pre-latching position V.

In the pre-latching position V, the plug-in-connector securing means 400 is latched on the plug-in connector 10 and the contact casing 100 in its two directions of movement—i.e. in and counter to the direction of insertion S of the plug-in connector 10. For this, the plug-in-connector securing means 400 has at least one latch means 420, preferably formed as a latch tab 420, by means of which on one hand latching in the pre-latching position V in both directions of movement on the plug-in connector 10, and on the other hand latching with a latch means 820 preferably formed as a latch projection 820 in the mating connector 80 counter to the direction of insertion S of the plug-in-connector securing means 400 (final latching position E), can be realised. Preferably the plug-in-connector securing means 400 has two such latch means 420 or latch tabs 420, only one being referred to below.

The latch tab 420 has, for latching with the contact casing 100, a first latch surface 421 which in the pre-latching position V in the direction of insertion S of the plug-in connector 10 prevents movement of the plug-in-connector securing means 400 in the direction of the final latching position E. For this, preferably a projection is formed on the preferably elongate latch tab 420 on one of its two-dimensional long sides which provides the first latch surface 421. In the pre-latching position V and an unloaded state of the latch tab 420, the first latch surface 421 lies against a first inner bearing region 121 of the contact casing 100 (see FIG. 8.) At the same time, the latch tab 420 lies with a second latch surface 423 provided on its longitudinal end section against a second inner bearing region 123 of the contact casing 100 (see FIG. 7). The two bearing regions 121, 123 in this case are at least partially remote from each other.

The latch tab 420 has at its free end a preferably oblique actuating surface 422 which upon advancing of the plug-in connector 10 into the electrical mating connector 80 displaces the latch tab 420 to one side. For this, the mating connector 80 has an actuating edge 822 or actuating surface 822 on which the actuating surface 422 of the latch tab 420 slides away upon movement of the plug-in connector 10 in the direction of insertion S and thus displaces the latch tab 420. Further in the direction of insertion S of the plug-in connector 10, preferably beneath the actuating edge 822, the mating connector 80 has a latch surface 823 on which the second latch surface 423 of the latch tab 420 latches in the final latching position E of the plug-in-connector securing means 400, with the latch tab 420 preferably moving back into its starting position.

Upon lateral displacement of the latch tab 420, the first latch surface 421 disengages from the first bearing region 121 of the contact casing 100. Upon movement of the plug-in-connector securing means 400 in the direction of the final latching position E, the projection on which the first latch surface 421 is provided then moves through a gap 125 in the contact casing 100, which means that this latching is no longer effective and the final latching position E of the plug-in-connector securing means 400 can be realised. Upon movement of the latch tab 420 back into its starting position in the final latching position E, the projection on which the first latch surface 421 is provided does not hinder the movement-back thereof; that is to say that a corresponding gap is provided in the contact casing 100.

The second inner bearing region 123 of the contact casing 100 is provided on a means which is diamond-shaped in the longitudinal direction L of the plug-in connector 10. At the top on this means, at least one actuating surface 122 for setting up the pre-latching position V of the plug-in-connector securing means 400 is provided, the latch tab 123 with the actuating surface 422 provided on its longitudinal end sliding away thereon and the pre-latching position V of the plug-in-connector securing means 400 on the plug-in connector 10 being able to be realised. This likewise lateral movement-away of the latch tab 420 takes place analogously to above embodiments.

The invention claimed is:

1. A connector assembly for an electrical socket plug-in connector for an igniter of an airbag, comprising:

a contact casing in which at least one electrical contact can be provided;

a contact securing member having a strain-relief member and a locking member for locking the contact in the contact casing;

a strain-relief cover;

the strain relief cover and contact securing member being movable relative to each other and to the contact casing, and the strain relief cover and contact securing member being latchable to each other, wherein the strain relief cover and strain relief member together provide a strain relief for an electric line connected to the at least one contact; and a plug-in-connector securing member coupled to, but movable relative to, the contact casing which, starting from a pre-latching position on the connector assembly, for a final latching position can be brought into engagement with one of the contact securing member and strain-relief cover.

2. A connector assembly according to claim 1, wherein the strain-relief cover of the connector assembly having a strain-relief member means which, in cooperation with the strain-relief member of the contact securing member, a strain relief can be set up for the line connected to the contact, preferably for the setting-up of the strain relief for the line, the strain-relief members being able to be moved substantially diametrically towards each other, and by way of the strain-relief members, an electrical insulation of the line being able to be mechanically clamped therebetween preferably in each case by way of at least one tooth.

3. A connector assembly according to claim 1, with a choke for the plug-in connector which is formed in particular as a ferrite being able to be received substantially without play in one dimension between the contact securing member and the strain-relief cover, for which the strain-relief cover preferably has a stop or a projection and/or the contact securing member preferably has a projection or a stop and the choke can be clamped therebetween, and/or for which the strain-relief cover and/or the contact securing member preferably have a spring, in particular a spring tab, wherein the choke can be pressed in the direction of the strain-relief cover or in the direction of the contact securing member.

4. A connector assembly according to claim 1, the plug-in-connector securing member having an engagement member preferably formed as a projection or stud, which engagement member can be brought into engagement with an engagement member of the contact securing member which is preferably formed as a recess or through-recess, and/or the plug-in-connector securing member having a latch member preferably formed as a latch projection or latch hook, which latch member can be brought into engagement with a latch member of the strain-relief cover which is preferably formed as an undercut recess or through-recess.

5. A connector assembly according to claim 1, the contact securing member and the strain-relief cover being able to be secured to each other preferably in the region of the respective strain-relief member, with preferably a latch member formed as a latch hook being provided on the strain-relief member and preferably a latch member formed as a latch shoulder being provided on the strain-relief member, and the latch member being preferably provided on a free longitudinal end section of the strain-relief member of the contact securing member, and the latch member being preferably provided on a middle section of the strain-relief member of the strain-relief cover.

6. A connector assembly according to claim 1, the strain-relief member of the contact securing member being able to be engaged in a recess in the strain-relief member of the strain-relief cover, with the insulation of the line being able to be pressed against two sections of the strain-relief member in a mutually engaged state of the two strain-relief member, by way of a section of the strain-relief member.

7. A connector assembly according to claim 1, the contact securing member having a longitudinal section extending along a longitudinal direction of the connector assembly, which section connects the locking member with the strain-relief member preferably in one piece in terms of material; and a projection or stop or the spring or spring tab for clamping the choke member being provided internally on the longitudinal section preferably adjacent to the strain-relief member.

8. A connector assembly according to claim 1, the contact securing member in the longitudinal direction of the connector assembly being approximately U-shaped in a cross-sectional projection and being able to be secured by both limbs on the connector assembly, with by way of the plug-in-connector securing member the contact securing member being able to be held on the connector assembly on a longitudinal end and/or on a middle section of its longitudinal section, or the contact securing member being able to be secured therewith on the contact casing.

9. A connector assembly according to claim 1, the plug-in-connector securing member being a component integrated in the connector assembly and preferably having in sections a completely circumambient wall; the wall having a guide recess with which the plug-in-connector securing member is seated in movable manner on a guide tab of the contact casing; the strain-relief member of the contact securing member preferably being able to be engaged in a section of the guide tab which projects out of the guide recess; the choke being able to be received between the strain-relief member of the strain-relief cover and a step section of the contact; and/or the contact securing member being able to be latched with the contact casing on an end of its longitudinal section which is located opposite the strain-relief member.

10. An electrical plug-in connector, in particular electrical socket plug-in connector, or manufactured electric cable, in particular for an igniter of an airbag, with a connector assembly according to claim 1, at least one electrical contact being locked in a contact casing of the connector assembly, to which an electric line is optionally connected.

11. The connector assembly of claim 1, wherein the strain-relief cover and the contact securing member are movable towards each other to trap the electric line therebetween.

12. The connector assembly of claim 11, wherein the strain-relief cover and the contact securing member are movable in a first direction transverse to a length of the electric line.

13. The connector assembly of claim 12, wherein the plug-in-connector securing member is movable in a direction transverse to the first direction.

* * * * *